US008115724B2

(12) United States Patent
Hung et al.

(10) Patent No.: US 8,115,724 B2
(45) Date of Patent: Feb. 14, 2012

(54) DRIVING CIRCUIT FOR DISPLAY PANEL

(75) Inventors: Der-Ju Hung, Tucheng (TW); Cheng-Chung Yeh, Taipei (TW)

(73) Assignee: Sitronix Technology Corp., Hsinchu County (TW)

( * ) Notice: Subject to any disclaimer, the term of this patent is extended or adjusted under 35 U.S.C. 154(b) by 516 days.

(21) Appl. No.: 12/413,699

(22) Filed: Mar. 30, 2009

(65) Prior Publication Data

US 2010/0245315 A1 Sep. 30, 2010

(51) Int. Cl.
*G09G 3/36* (2006.01)

(52) U.S. Cl. ..... 345/98; 345/211

(58) Field of Classification Search ..... 345/87–100, 345/204, 211

See application file for complete search history.

(56) References Cited

U.S. PATENT DOCUMENTS 7,482,816 B2 * 1/2009 Odajima et al. ..... 324/548
7,623,109 B2 * 11/2009 Sato et al. ..... 345/98
7,825,919 B2 * 11/2010 Woo et al. ..... 345/211
7,852,358 B2 * 12/2010 Kudo et al. ..... 345/690
2002/0050941 A1 * 5/2002 Nozaki ..... 341/158
2002/0067328 A1 * 6/2002 Yumoto et al. ..... 345/92
2003/0151577 A1 * 8/2003 Morita ..... 345/89
2006/0187163 A1 * 8/2006 Hashimoto ..... 345/88
2007/0001939 A1 * 1/2007 Hashimoto et al. ..... 345/76
2007/0046589 A1 * 3/2007 Furuichi ..... 345/76
2008/0111649 A1 * 5/2008 Ryu ..... 333/17.3
2010/0214206 A1 * 8/2010 Yokoyama et al. ..... 345/100

* cited by examiner

*Primary Examiner* — Nitin Patel
(74) *Attorney, Agent, or Firm* — Ming Chow; Sinorica, LLC

(57) ABSTRACT

The present invention relates to a driving circuit for a display panel, and comprises a switching module, a buffer circuit, and a plurality of resistive devices. The switching module is coupled to a first power supply and a second power supply. The voltage of the first power supply is smaller than that of the second power supply. The buffer circuit is coupled to the switching module, and is used for buffering a data signal and producing a buffer signal. The plurality of resistive devices is connected in series and coupled to the buffer circuit, and produces a plurality of driving signals between the plurality of resistive devices according to the buffer signal. The driving circuit switches between the first power supply and second power supply sequentially to supply power to the buffer circuit. Thereby, one of the plurality of driving signals charges a capacitor of the display panel for saving power of the driving circuit. Accordingly, the power of the display can be saved.

12 Claims, 6 Drawing Sheets

DRIVING CIRCUIT FOR DISPLAY PANEL

FIELD OF THE INVENTION

The present invention relates to a driving circuit, and particularly to a driving circuit for a display panel.

BACKGROUND OF THE INVENTION

Modern technologies develop prosperously. Information products are introduced continuously to satisfy varied demands of numerous people. Most of early displays are cathode ray tubes (CRTs). However, their size is huge and their power consumption is great. In addition, the radiation they produced may endanger the health of long-term users. Thereby, current displays in the market are gradually replaced by liquid crystal displays (LCDs). LCDs have the characteristics of lightness, thinness, shortness, and smallness. Besides, they also have the advantages of low radiation and power consumption. Hence, they have become the mainstream of the market.

LCDs display images by controlling the light transmittance of liquid-crystal cells according to data signals. Because active-matrix LCDs adopt active control switches, the LCDs of this sort own advantages in displaying motion pictures. Thin-film transistors (TFTs) are switches mainly used in active-matrix LCDs.

FIG. 1 shows a schematic diagram of the driving system for an LCD according to the prior art. As shown in the figure, the driving system comprises a display panel 10', a scan driving circuit 12', a data driving circuit 14', a timing control circuit 16', and a circuit for producing reference voltages 18'. The display panel 10' is used for displaying images. The scan driving circuit 12' is used for producing and transmitting a scan signal to the display panel 10' for driving a thin-film transistor (TFT) of the display panel 10'. The data driving circuit 14' is used for producing and transmitting a data signal to the display panel 10' for displaying the images. The timing control circuit 16' produces a timing control signal, and transmitting the timing control signal to the scan driving circuit 12' and the data driving circuit 14', respectively, for controlling the scan driving circuit 12' and the data driving circuit 14' to transmit the scan signal and data signal to the display panel 10', respectively, and for displaying the images. In addition, the circuit for producing reference voltages 18' produces a reference voltage and transmits the reference voltage to the data driving circuit 14' for making the data driving circuit 14' to produce the data signal according to the timing control signal and the reference voltage.

FIG. 2 shows a schematic diagram of a circuit for producing reference voltages according to the prior art. If the digital display data corresponding to RGB is comprised by, for example, 6 bits, the circuit for producing reference voltages 18' can output 64 analog voltages V0~V63 corresponding to $2^6$=64 grayscales. The circuit for producing reference voltage 18' is comprised by resistive voltage division circuit including resistors R0~R7 connected in series. Each of the resistors R0~R7 is further comprised by 8 resistors connected in series. As shown in FIG. 3, the 8 resistors R01~R08 are connected in series to form the resistor R0. Other resistors R1~R7 are formed similarly. Thereby, the circuit for producing reference voltages 18' is comprised by 64 resistors and produces voltages V0~V63.

However, because 64 resistors are needed to produce 64 different voltage levels, the area of the circuit for producing reference voltages 18' is increased, and hence increasing the area of the display. Besides, in order to reduce the area of the circuit for producing reference voltages 18', resistors with larger resistance have to be used, which will affect the driving capability of the data driving circuit 14'. Moreover, when the data driving circuit 14' drives the display panel 10' via the resistors, a large amount of power will be consumed on the resistors, and thus wasting power of the display.

Accordingly, the present invention provides a novel driving circuit for a display panel, which can reduce the amount of resistors used without sacrificing the driving capability of the data driving circuit 14'. Thereby, the area of the display can be reduced, and the power of the display can be saved.

SUMMARY

An objective of the present invention is to provide a driving circuit for a display panel, which uses a switching module to switch a first power supply or a second power supply to a buffer circuit for saving power of the driving circuit, and hence saving power of the display.

Another objective of the present invention is to provide a driving circuit for a display panel, which uses a digital-to-analog converter for reducing the amount of resistive devices used, and hence saving area of the display.

The driving circuit for a display panel according to the present invention comprises a switching module, a buffer circuit, and a plurality of resistive devices. The switching module is coupled to a first power supply and a second power supply. The voltage of the first power supply is smaller than that of the second power supply. The buffer circuit is coupled to the switching module, and is used for buffering a data signal and producing a buffer signal. The plurality of resistive devices is connected in series, and is coupled to the buffer circuit. A plurality of driving signal is produce between the plurality of resistive devices according to the buffer signal. The driving circuit switches between the first power supply and second power supply sequentially to supply power to the buffer circuit. Thereby, one of the plurality of driving signals charges a capacitor of the display panel for saving power of the driving circuit. Accordingly, the power of the display can be saved.

DETAILED DESCRIPTION

In order to make the structure and characteristics as well as the effectiveness of the present invention to be further understood and recognized, the detailed description of the present invention is provided as follows along with preferred embodiments and accompanying figures.

Figure 1:
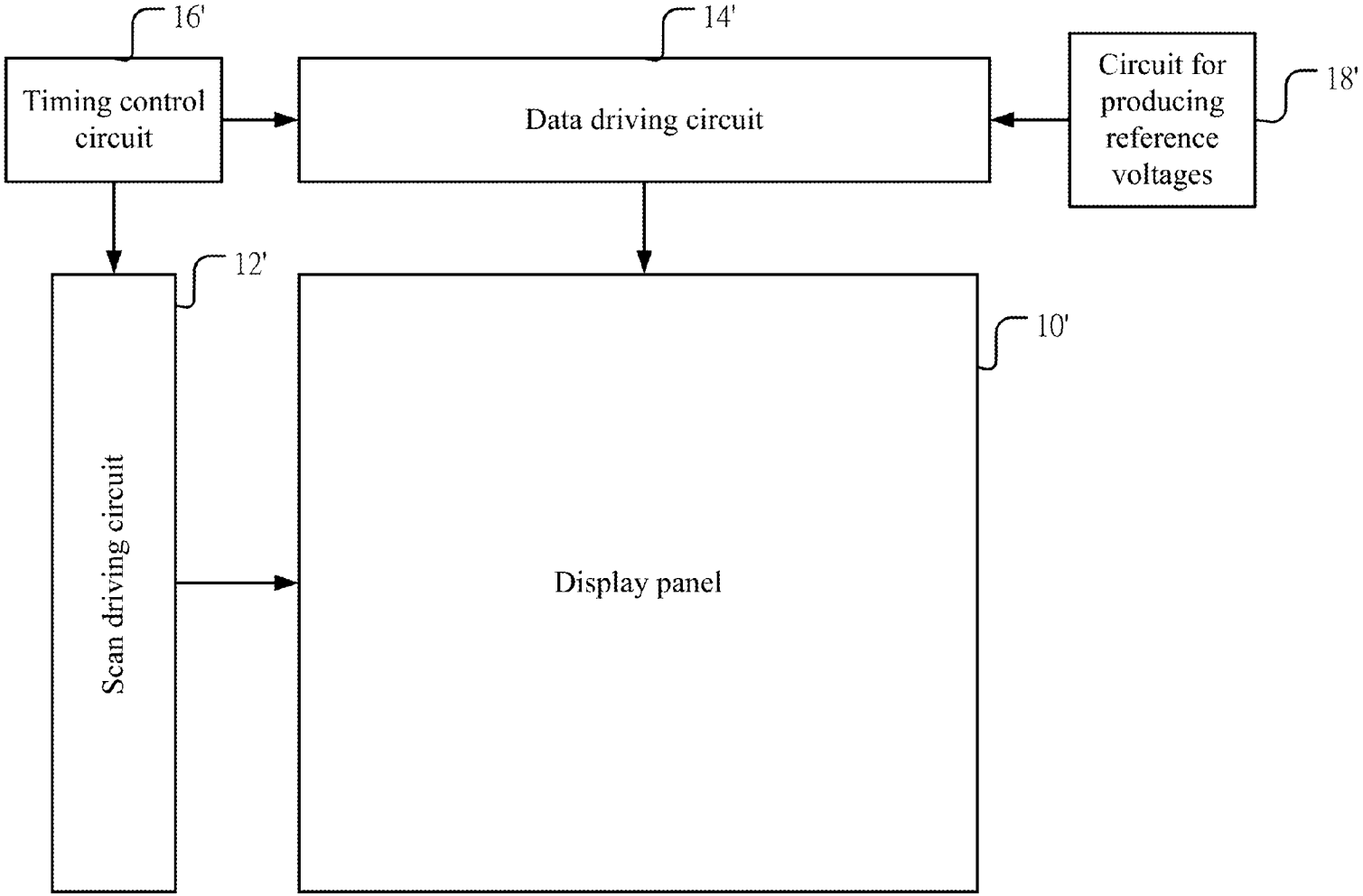
Figure 1 (Prior Art)
FIG. 1 shows a schematic diagram of the driving system for an LCD according to the prior art.
Figure 2:
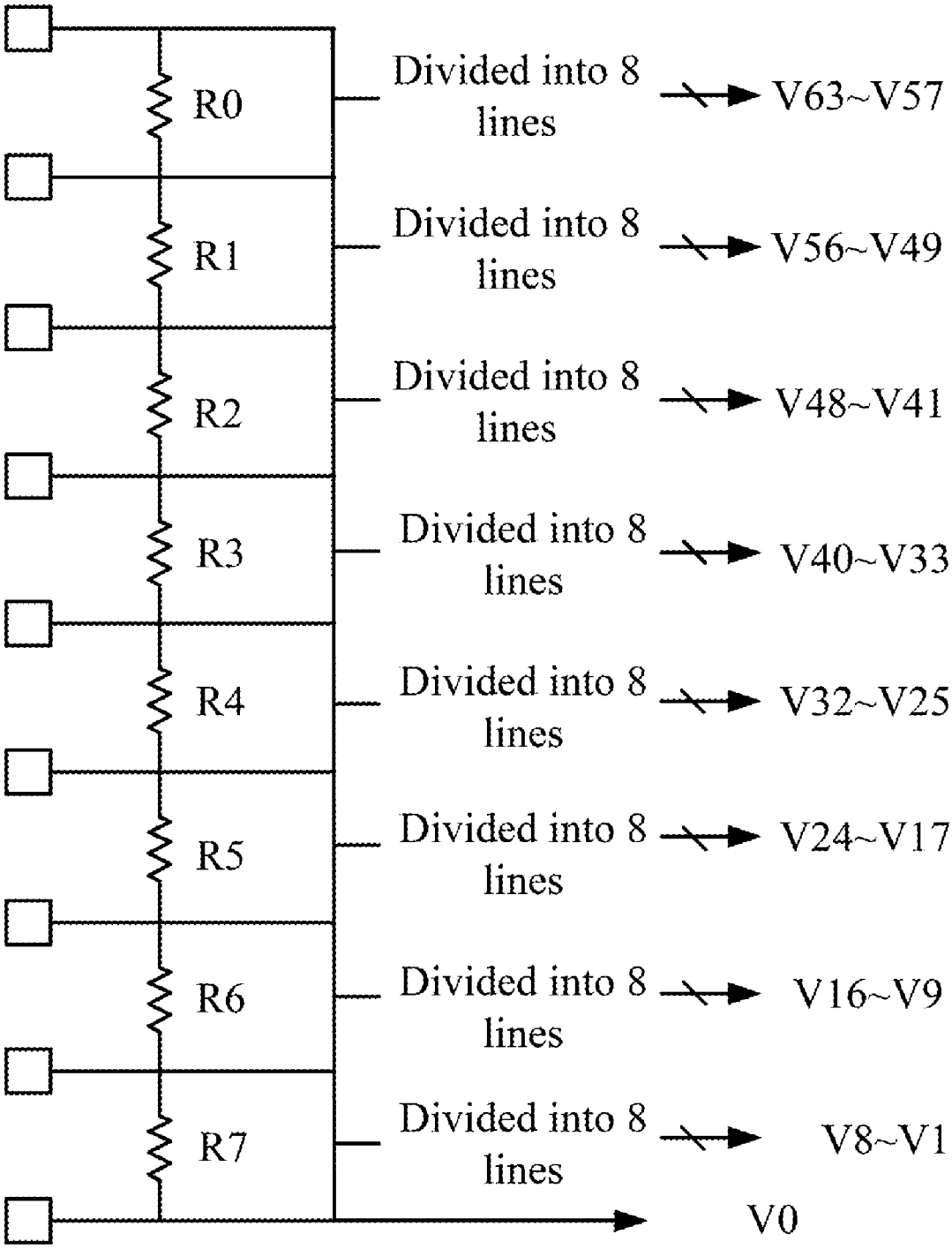
Figure 2(Prior Art)
FIG. 2 shows a schematic diagram of a circuit for producing reference voltages according to the prior art.
Figure 3:
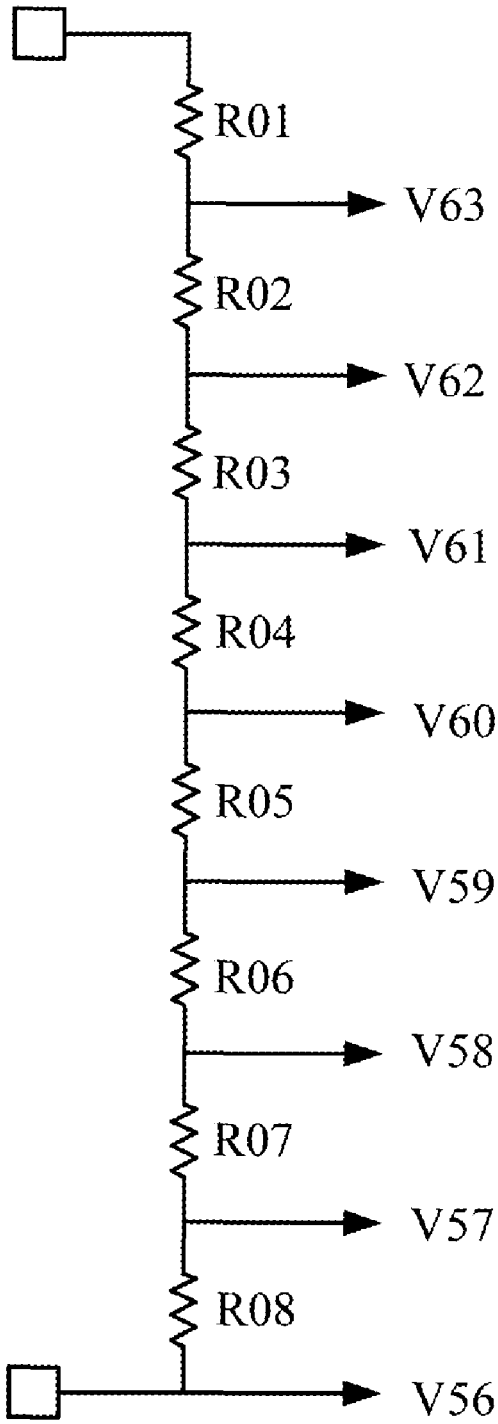
Figure 3 (Prior Art)
FIG. 3 shows a schematic diagram of a detailed circuit for producing reference voltages according to the prior art.
Figure 4:
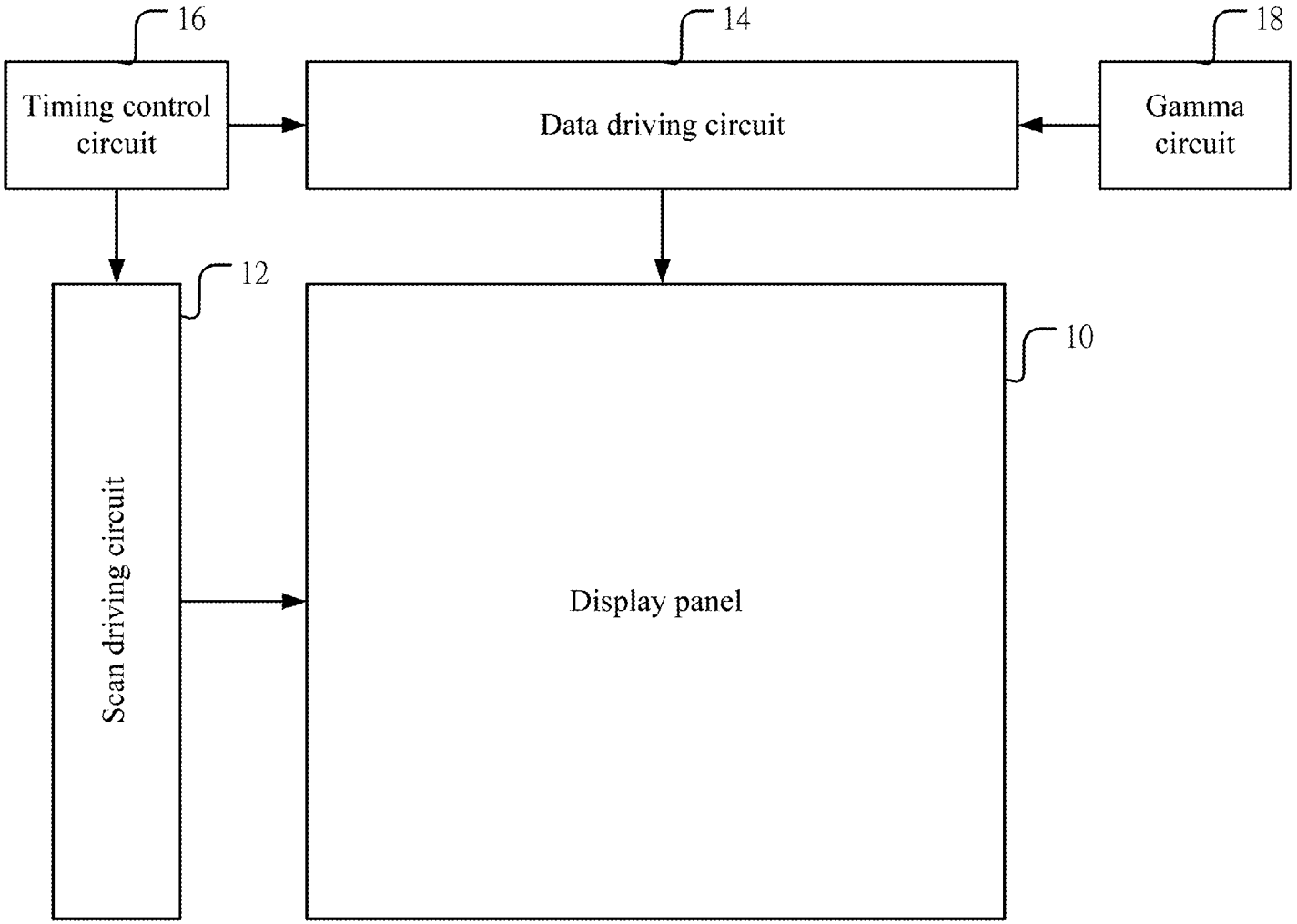
FIG. 4 shows a schematic diagram of the driving system for an LCD according to a preferred embodiment of the present invention.

FIG. 4 shows a schematic diagram of the driving system for an LCD according to a preferred embodiment of the present invention. As shown in the figure, the driving system comprises a display panel 10, a scan driving circuit 12, a data driving circuit 14, a timing control circuit 16, and a Gamma circuit 18. The display panel 10 is used for display images. The scan driving circuit 12 is used for producing and transmitting a scan signal to the display panel 10 to drive a thin-film transistor (TFT) of the display panel 10. The data driving circuit 14 is used for producing and transmitting a data signal to the display panel 10 to display the images according to the data signal. The timing control circuit 16 produces a timing control signal and transmits the timing control signal to the scan driving circuit 12 and the data driving circuit 14 for controlling the scan driving circuit 12 and the data driving circuit 14 to transmit the scan signal and data signal to the display panel 10, respectively. Thereby, the images can be displayed. In addition, the Gamma circuit 18 produces a reference voltage and transmits the reference voltage to the data driving circuit 14. Hence, the data driving circuit 14 can produce the data signal according to the timing control signal and the reference voltage.

Figure 5:
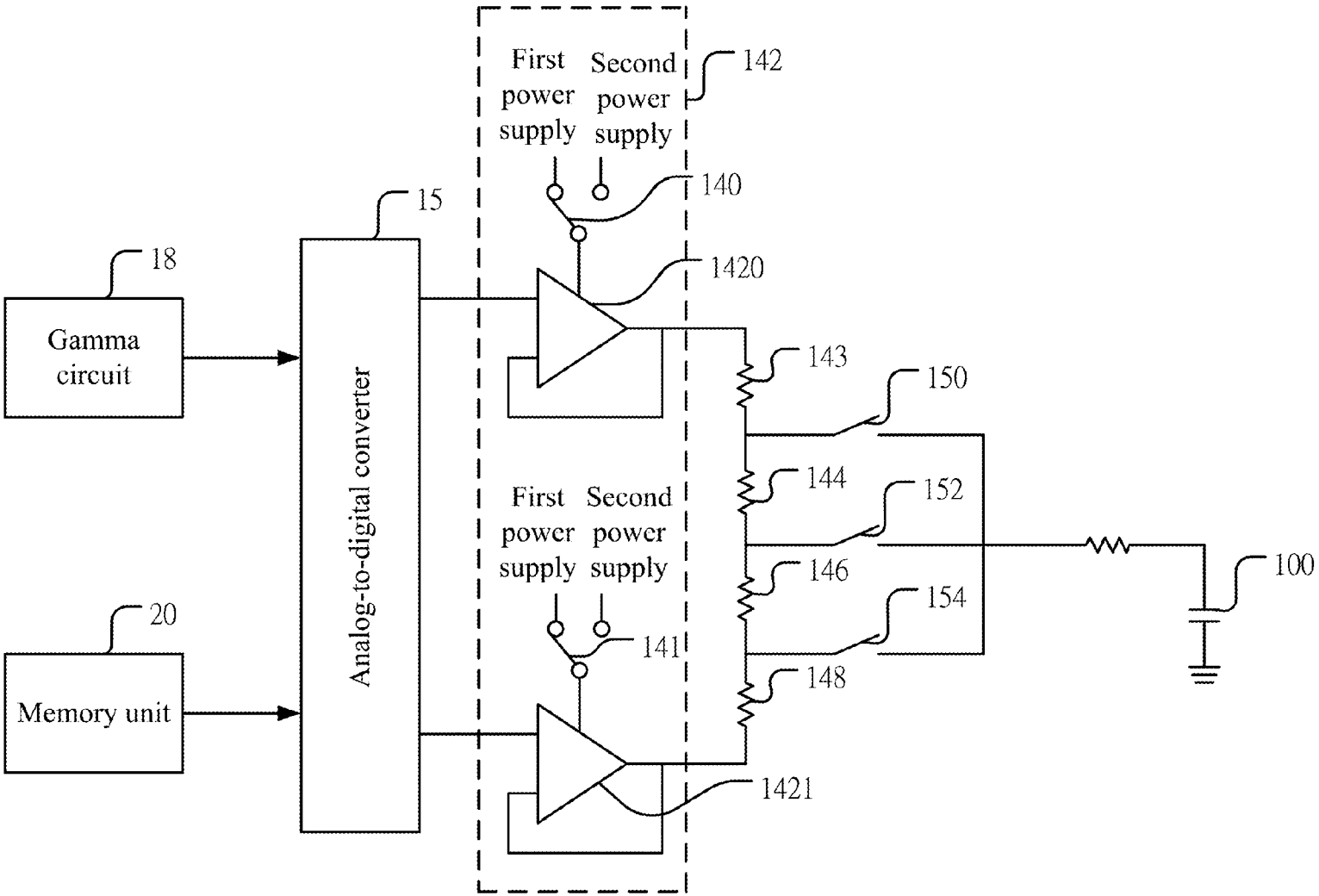
FIG. 5 shows a block diagram according to a preferred embodiment of the present invention.

FIG. 5 shows a block diagram according to a preferred embodiment of the present invention. As shown in the figure, the driving circuit for a display panel according to the present invention is applied to the data driving circuit 14 for receiving 64 voltage levels produced by the Gamma circuit 18. Because the driving circuit according to the present invention can receive 8-bit signals, the data driving circuit 14 needs to use 8 driving circuits for receiving and processing said 64 voltage levels. According to the present preferred embodiment, only one driving circuit is used for description. The driving circuit according to the present invention comprises a switching module, a buffer circuit 142, and a plurality of resistive devices 143, 144, 146, 148. The switching module is coupled to a first power supply and a second power supply. The voltage of the first power supply is smaller than that of the second power supply. According to a preferred embodiment, the voltage of the second power supply is twice the voltage of the first power supply. The buffer circuit 142 is coupled to the switching module, and is used for buffering a data signal and producing a buffer signal. The plurality of resistive devices 143, 144, 146, 148 is connected in series and is coupled to the buffer circuit 142. Namely, one end of the resistive device 143 is coupled to the buffer circuit 142, and the other end thereof is connected with the resistive device 144 in series; one end of the resistive device 148 is coupled to the buffer circuit 142, and the other end thereof is connected with the resistive device 146 in series. The plurality of resistive devices 143, 144, 146, 148 produces a plurality of driving signal therebetween according to the buffer signal. The driving circuit switches between the first power supply and second power supply sequentially to supply power to the buffer circuit 142. Thereby, one of the plurality of driving signals charges a capacitor 100 of the display panel. Accordingly, the power of the driving circuit can be saved, and hence the power of the display can be saved.

Figure 6:
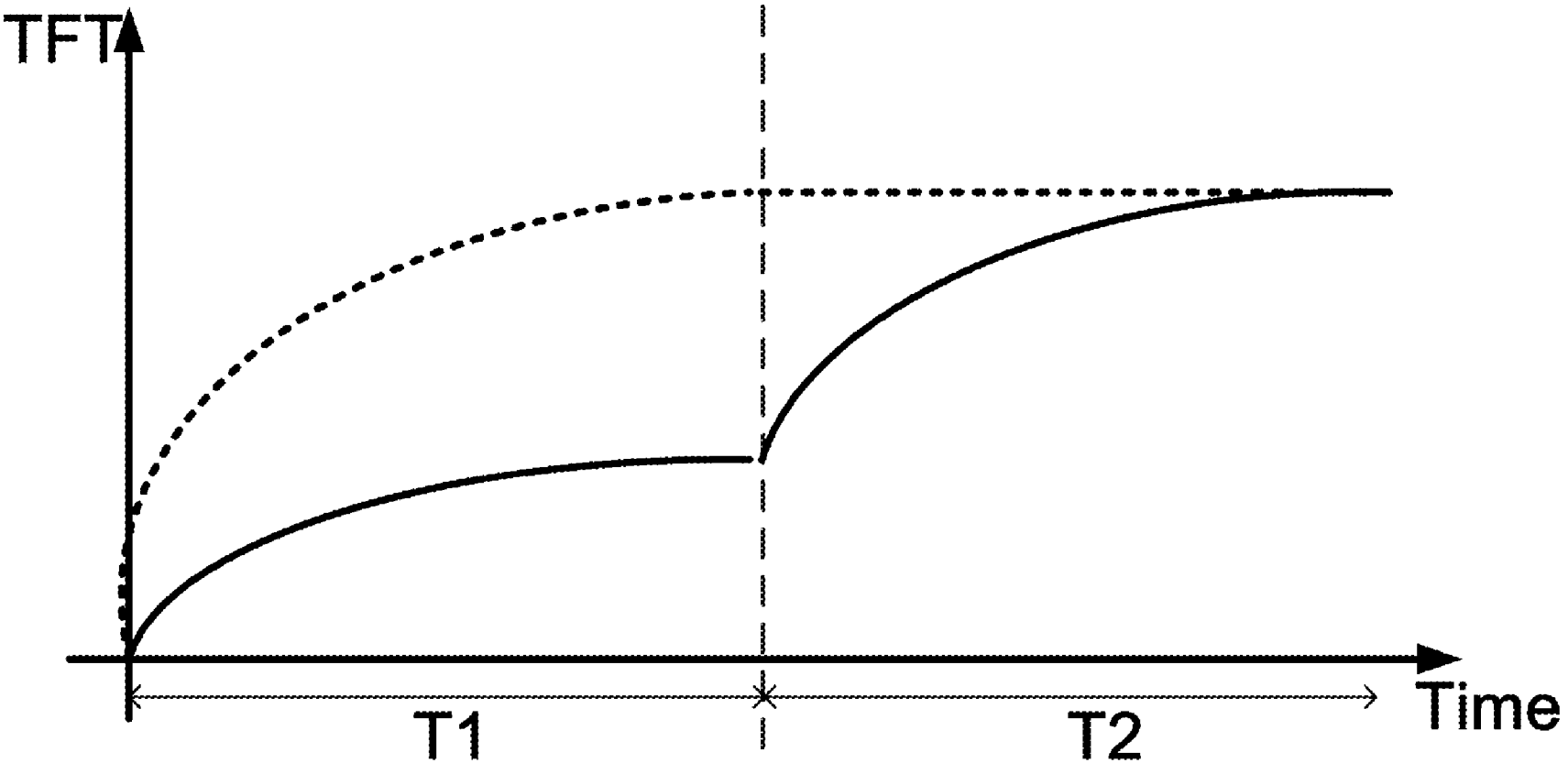
FIG. 6 shows a timing diagram of driving according to a preferred embodiment of the present invention.

FIG. 6 shows a timing diagram of driving according to a preferred embodiment of the present invention. As shown in the figure, the dashed line represents that the driving circuit charges the capacitor 100 directly by a doubled unit voltage and drives the display panel 10. On the other hand, the solid line represents that the driving circuit first switches to the first power supply by means of the switching module for supplying power to the buffer circuit 142, where the first power supply has a unit voltage. After a period of time, the switching module switches to the second power supply for supplying power to the buffer circuit 142, where the second power supply has a doubled unit voltage. From the figure, it is known that the power consumption of the driving circuit supplying power to the buffer circuit by two-step voltages according to the present invention is less than that by merely a doubled unit voltage. That is to say, during the time T1, the driving circuit supplies power to the buffer circuit 142 by a unit voltage provided by the first power supply. Then, during the time T2, the driving circuit supplies power to the buffer circuit 142 by a doubled unit voltage provided by the second power supply. Thereby, the power of the driving circuit according to the present invention can be truly saved, and accordingly the power of the display can be saved.

In addition, the driving circuit according to the present invention further comprises an analog-to-digital converter 15 used for converting an input signal and producing the data signal. The analog-to-digital converter 15 is coupled to the Gamma circuit 18 for receiving correction data produced by the Gamma circuit 18 as the input signal. The Gamma signal 18 produces the correction data according to a Gamma curve. Besides, the analog-to-digital converter 15 is further coupled to a memory unit 20, which is used for storing a plurality of pixel data. The analog-to-digital converter 15 receives the plurality of pixel data and the correction data as the input signal and produces the data signal. The memory unit 20 is a random access memory (RAM).

Referring back to FIG. 5, a first switch 150, a second switch 152, and a third switch 154 are set between the plurality of resistive devices 143, 144, 146, 148. The analog-to-digital converter can produce a control signal according to the pixel data stored in the memory unit 20 for closing/opening the first switch 150, the second switch 152, or the third switch 154. Furthermore, the buffer circuit 142 includes a first buffer 1420 and a second buffer 1421. The first buffer 1420 is used for buffering the data signal and producing a first buffer signal; the second buffer 1421 is used for buffering the data signal and producing a second buffer signal. The plurality of resistive devices 143, 144, 146, 148 produces the driving signal according to the voltage difference between the first buffer signal produced by the first buffer 1420 and the second buffer signal produced by the second buffer 1421. The first buffer 1420 and the second buffer 1421 are operational amplifiers. In addition, the switching module includes a first switching mechanism 140 and a second switching mechanism 142. The first switching mechanism 140 is used for switching between the first power supply and the second power supply and then power can be supplied to the first buffer 1420. Likewise, the second switching mechanism 142 is used for switching between the first power supply and the second power supply and then power can be supplied to the second buffer 1421.

To sum up, the driving circuit for a display panel according to the present invention comprises a switching module, a buffer circuit, and a plurality of resistive devices. The switching module is coupled to a first power supply and a second power supply. The voltage of the first power supply is smaller than that of the second power supply. The buffer circuit is coupled to the switching module, and is used for buffering a data signal and producing a buffer signal. The plurality of resistive devices is connected in series and coupled to the buffer circuit, and produces a plurality of driving signals between the plurality of resistive devices according to the buffer signal. The driving circuit switches between the first power supply and second power supply sequentially to supply power to the buffer circuit. Thereby, one of the plurality of driving signals charges a capacitor of the display panel for saving power of the driving circuit. Accordingly, the power of the display can be saved.

Accordingly, the present invention conforms to the legal requirements owing to its novelty, non-obviousness, and utility. However, the foregoing description is only a preferred embodiment of the present invention, not used to limit the scope and range of the present invention. Those equivalent changes or modifications made according to the shape, structure, feature, or spirit described in the claims of the present invention are included in the appended claims of the present invention.

The invention claimed is:

1. A driving circuit for a display panel, comprising:

a switching module, coupled to a first power supply and a second power supply, and a voltage of the first power supply being smaller than that of the second power supply;

a buffer circuit, coupled to the switching module, and used for buffering a data signal and producing a buffer signal; and a plurality of resistive devices, connected in series and coupled to the buffer circuit, and producing a plurality of driving signals between the plurality of resistive devices according to the buffer signal;

wherein the driving circuit switches between the first power supply and second power supply sequentially to supply power to the buffer circuit, and hence one of the plurality of driving signals charges a capacitor of the display panel.

2. The driving circuit of claim 1, wherein the voltage of the second power supply is twice the voltage of the first power supply.

3. The driving circuit of claim 1, and applied to a data driving circuit of the display panel.

4. The driving circuit of claim 1, and further comprising an analog-to-digital converter, used for converting an input signal and producing the data signal.

5. The driving circuit of claim 4, and further comprising a Gamma circuit, producing and transmitting the input signal to the analog-to-digital converter according to a Gamma curve.

6. The driving circuit of claim 1, and further comprising a plurality of switches, one end of switches coupled between the plurality of resistive devices, respectively, the other end of the switches coupled to the display panel, one of the plurality of switches being closed according to a control signal, and producing and transmitting the driving signals to the capacitor.

7. The driving circuit of claim 6, and further comprising an analog-to-digital converter, producing the control signal according to an input signal for closing one of the plurality of switches.

8. The driving circuit of claim 1, wherein the buffer circuit comprises:

a first buffer, used for buffering the data signal, and producing a first buffer signal; and a second buffer, used for buffering the data signal, and producing a second buffer signal.

9. The driving circuit of claim 8, wherein the buffer circuit comprises:

a first switching mechanism, used for switching between the first power supply and the second power supply for supplying power to the first buffer; and a second switching mechanism, used for switching between the first power supply and the second power supply for supplying power to the second buffer.

10. The driving circuit of claim 8, wherein the second buffer is an operational amplifier.

11. The driving circuit of claim 8, wherein the first buffer is an operational amplifier.

12. The driving circuit of claim 1, wherein the resistive device is a resistor.

* * * * *